United States Patent [19]

Parry

[11] 4,179,081

[45] Dec. 18, 1979

[54] APPARATUS FOR APPLICATION OF PLASTICS STRETCH FILMS

[76] Inventor: John C. Parry, 6729 Brookmont Dr., Baltimore, Md. 21207

[21] Appl. No.: 914,801

[22] Filed: Jun. 12, 1978

[51] Int. Cl.[2] ..... B65H 17/44

[52] U.S. Cl. ..... 242/99

[58] Field of Search ..... 242/99, 96, 75.4, 156, 242/156.2

[56] References Cited

U.S. PATENT DOCUMENTS

| | | | |
|---|---|---|---|
| 521,245 | 6/1894 | Partridge | 242/99 |
| 2,917,249 | 12/1959 | MacLelland | 242/99 X |
| 3,198,175 | 8/1965 | Dean | 242/99 X |

*Primary Examiner*—Edward J. McCarthy
*Attorney, Agent, or Firm*—Walter G. Finch

[57] ABSTRACT

The invention is an improved apparatus for the manual application of plastics stretch films to materials and items to be packaged and secured as a unit or packaged and secured to a shipping and transporting means. The apparatus consists of an extended core for the supply of plastics stretch film and a pair of tubular-like grip means for said extended core. Said grip means serving as a manual control means for the speed of paying out the plastics stretch film material, and as a manual means for applying tension on the film during the course of applying it to materials and items.

11 Claims, 4 Drawing Figures

APPARATUS FOR APPLICATION OF PLASTICS STRETCH FILMS

BACKGROUND AND SUMMARY OF THE INVENTION

The invention relates to packaging and shipping systems and in particular to packaging of materials and items to be secured as a unit load or to be secured to a shipping and transporting means, such as a pallet. Specifically, it relates to such systems using plastics stretch film (a high cling film) as the binding and securing agent.

A need has existed for some time for a simple and economical means for manually applying plastics stretch film material. This invention provides that simple and economical means to do the work.

In the prior art two methods are available for applying the plastics stretch film material to materials and units to be packaged or secured as hereinbefore described.

One method is to use a very expensive automatic machine to hold a supply of the plastics stretch film and to automatically wrap it around the unit of materials to be packaged; and to secure the unit of materials to a shipping or transporting means. Such machines require the attention of an operator and they do have their own limitations.

Another method is to use a commercial manually operated grabbing or holding device. However, this manually operated device is very expensive in comparison to the cost of the present invention. The commercial device is difficult to adjust to obtain the wide range of speeds and tensions that are required while manually wrapping the plastics stretch film to a unit load. The adjusting system on the commercial unit is such that it is difficult to "feel" the fine line between "full stop" and "just barely moving." As a result, many broken films are encountered during use of the commercial unit. The present invention eliminates these problems and is extremely simple to operate.

One of the devices in the prior art consists of a shaft means passing through the tubular core of the roll of plastics film material. The shaft has more or less "D" shaped hand grips on each end that are held by the operator and used to pull the plastics film around or over the unit or load being packaged or secured. When more tension is to be placed on the plastics film, one of the two hand grips is twisted to tighten the shaft movement through the core of the roll of plastics film. This tightening by twisting one of the hand grips does not provide a sensitive "feel" in the operator's hands and is the cause of the frequent breaking of the plastics film mentioned hereinbefore.

Another of the devices in the prior art consists of a shaft means passing through the aforementioned tubular core of the roll of plastics film material. The shaft also has more or less "D" shaped hand grips on each end as hereinbefore described, but the tension adjustment is provided by a brake-nut on the end of the shaft. Changes in the need for more or for less tension requires the operator to use one hand to operate the brake-nut while holding the roll of plastics film with the other hand in one of the "D" shaped hand grips. This method of adjusting the tension is an awkward operation to perform. In addition, this method also causes frequent breaks of the plastics film.

In the present invention the control of the amount of tension is by the direct pressure or the squeeze of the operators hands on the flexible tube-like devices around extended ends of the core of the roll of plastics material. Two embodiments are provided for extending the core ends of the roll of the plastics material, however, the tension control means is the same in each case.

In the prior art the fixing of the device to a roll of plastics stretch film required considerable time and effort to insert a shaft through or to drive a toothed or spiked shaft into the ends of the core of the roll of plastics stretch film, and then add hand grips, holding or securing nuts, and other such mechanical operations. In the present invention, the preparation is primarily the slipping of two flexible hand grips on the ends of the core of the roll of plastics stretch film or on simple inserts in the core.

It is, therefore, an object of the invention to provide a system for manually applying plastics stretch film to a unit that is economical to manufacture and simple to operate.

It is another object of the invention to provide a system for manually applying plastics stretch film to a unit that permits the operator to "feel" the movement and tension condition through the hands on the device of the system.

It is yet another object of the invention to provide a system for manually applying plastics stretch film to a unit that consists of two simple flexible hand grips.

It is a further object of the invention to provide a system for manually applying plastics stretch film to a unit that does not require the operator to remove the hands from the device to change the tension setting.

Further objects and advantages of the invention will become apparent in light of the following description of the preferred embodiments.

DESCRIPTION OF THE PREFERRED EMBODIMENT

Figure 1:
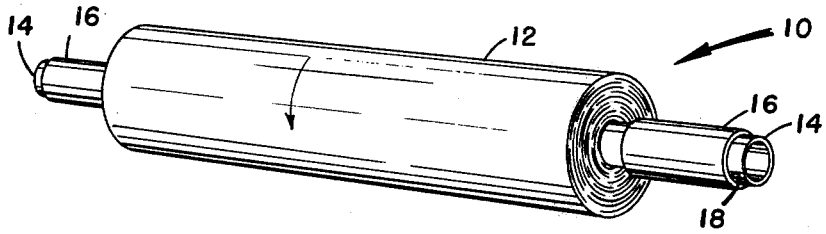
FIG. 1 is a pictorial view of a first embodiment of flexible hand grips on extended core ends of a roll of plastics stretch film.
Figure 3:
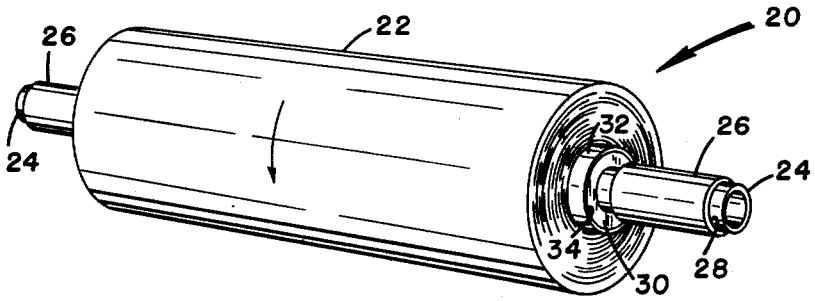
FIG. 3 is a pictorial view of a second embodiment of flexible hand grips on core extensions of a roll of plastics stretch film.

Referring to the drawings and particularly to FIGS. 1 and 3, a first embodiment of the system for plastics stretch film is seen at 10 in FIG. 1, and a second embodiment of the system for plastics stretch film is seen at 20 in FIG. 3.

In FIG. 1 a roll of plastics stretch film 12 is shown on a core 14. The direction of the core wrap of the roll of plastics stretch film 12 is shown by the arrow thereon, however, it is to be understood that the direction of the arrow on such a drawing could be reversed without changing the concept of this invention.

A pair of cylindrical flexible tube-like hand grips 16 are shown in FIG. 1 on the ends of said core 14 of said roll of plastics stretch film 12.

The inside diameter 18 of hand grips 16 is a close fit over the outside diameter of core 14, but with sufficient clearance so that the core 14 can turn easily within the hand grip 16.

Figure 2:
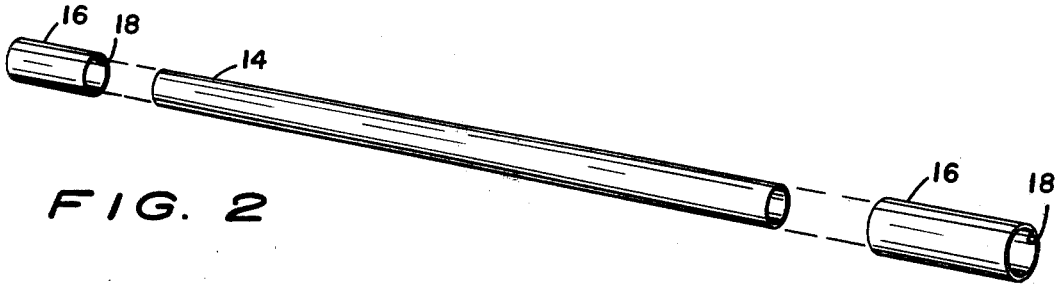
FIG. 2 is an exploded pictorial view of an extended length core for plastics stretch film and flexible hand grips.

In FIG. 2 the length of core 14 can be seen to be in one piece. The hand grips 16 are shown in an exploded view in relation to the core 14. The inside diameter 18 of hand grip 16 is shown in relation to the outside diameter of the core 14.

The extension of the core 14 on each side of the roll of plastics stretch film 12 for a distance on each side thereof that is slightly more than the length of the hand grip 16 is a part of this first embodiment of this invention. Thus, the extended length core 14, or in other words, the core 14 with extended ends, is an element of this invention.

It is to be noted that a hollow tube-like core is illustrated but it is to be understood that a solid rod-like core is within the scope and intent of this invention.

It is to be noted that the outside diameter of core 14 is smaller than the usual or normal diameter of prior art cores of rolls of plastics stretch film. The usual or normal diameter of prior art cores is shown as core 32 of the roll of plastics stretch film 22 in FIG. 3, which will be described hereinafter.

It is to be understood that the possible chance existence of a small diameter core for a roll of plastics stretch film in no way precludes the present invention. Cores for rolls of plastics stretch film are normally of a length approximating the width of the plastics stretch film wrapped thereon, and this invention includes the extension of the length of the core to provide extended ends as hereinbefore described for the first embodiment.

Figure 4:
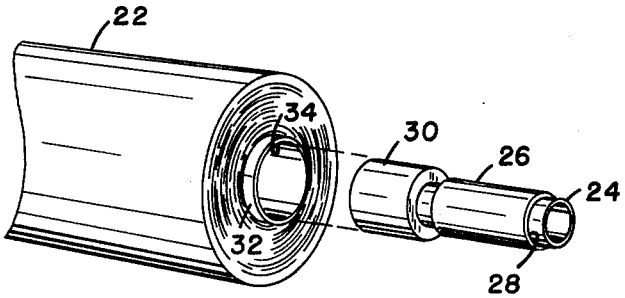
FIG. 4 is a partial exploded pictorial view of the second embodiment of a flexible hand grip on a core extension of a roll of plastics stretch film.

Turning now to the second embodiment of the system for plastics stretch film 20, the following description relates to FIGS. 3 and 4.

The second embodiment of the system for plastics stretch film 20 provides a means for using rolls of plastics stretch film 22 on core 32 where the length of the core 32 is approximately the same as the width of the roll of plastics stretch film 22. This second embodiment provides a means of using the roll of plastics stretch film 22 on a core 32 without the need for rerolling the plastics stretch film 22 off of a short length core such as core 32 on to a larger length core such as core 14 in FIGS. 1 and 2.

As noted hereinbefore, the usual or normal outside diameter of core 32 is larger than the outside diameter of core 14 of the first embodiment.

The second embodiment 20 provides a pair of adapters so that core 32 can be used with the same pair of hand grips 16 that are used in the first embodiment 10. In FIGS. 3 and 4 the hand grips 16 of the first embodiment 10 are shown as hand grips 26 for clarity when speaking of the second embodiment 20. Hand grips 16 of the first embodiment 10 and hand grips 26 of the second embodiment 20 are exactly alike and can be considered one and the same concept.

The aforementioned adapter is shown in FIGS. 3 and 4 at 30. It is to be noted that the adapter 30, one for each hand grip, may be constructed in two ways.

The first construction of adapter 30 is as a single washer-like plug. The outside diameter of adapter 30 is a very close and tight fit for the inside diameter 34 of core 32 of the roll of plastics stretch film 22. The outside surface of adapter 30 has a very slight taper in order to introduce it easily into the inside diameter 34 of core 32. A short length of core 24 (the size of core 24 being exactly the same as core 14 of the first embodiment as far as the diameter is concerned) is inserted into the inside diameter of the washer-like adapter 30 for a very tight friction held fit. This first construction is shown in FIGS. 3 and 4.

The second construction of adapter 30 is as a single piece unit where both the element 30 and the element 24 are of one-piece construction, the total being of the same overall configuration as the first construction, but not illustrated on the drawings. In this second construction the shape and taper of the element 30 for fitting the inside diameter 34 of core 32 are exactly the same as described for the first construction hereinbefore. In this second construction, the outside diameter of the element 24 is exactly the same as described for the first construction hereinbefore.

Hand grips 26 are placed on the adapter element 24 (either first or second construction) the same as hand grips 16 were placed on the extensions of core 14 in the first embodiment. The inside diameter 28 of hand grips 26 is a close fit over the outside diameter element 24, but with sufficient clearance so that element 24 can turn easily within the hand grip 26, the same as core 14 turns easily within hand grip 16 in the first embodiment.

As to the materials: the cores 14 and 32 are usually of cardboard-like or fiber material, but could be wood in rod-like configuration or could be any similar or suitable materials; the material of the adapter 30 may be wood, fiber, plastics or any similar or suitable material for the second construction or combination thereof for elements 30 and 24 of the first construction; the material for the hand grips 16 and 26 may be any flexible rubber-like material; flexible plastics type material, flexible paper or fiber-like material, or any similar or suitable material, as long as the material will be flexible when squeezed.

In operation, the user grips the hand grips 16 (for first embodiment) or 26 (for second embodiment) on the extension of core 14 or core extension 24, respectively, and gives a slight squeeze to the hand grips 16 (or 26) in order to "feel" the extension of core 14 (or core extension 24). In the description of the operation which follows, only the first embodiment 10 will be described, the description for the second embodiment 20 is exactly the same.

In case where the initial friction between the hand grips 16 or 26 and the cores 14 and 24 is too great to obtain a satisfactory "feel" or a free movement, a suitable lubricant, such as a light coating of powder or a wax may be used.

As the operator plays out the plastics stretch film 12 during the wrapping of a unit or the securing of unit to a transporting means, a sufficient grip is maintained on the hand grips 16 to provide the necessary control of tension on the plastics stretch film 12. This control of tension is gaged by the "feel" of the extension of core 14 through the soft flexible hand grips 16. The operator can make a full stop of the turning by a tight squeeze on hand grips 16 or the operator can have a free running play out of plastics stretch film 12 as the plastics stretch film unrolls by loosening the squeeze on hand grips 16. Varying of hand squeeze pressure on hand grips 16 permits the control of the play out of plastics stretch film 12 while also controlling how tightly the plastics stretch film 12 is pulled to provide the wrap or securing of the unit being packaged or secured. The squeezing of the hand grips 16 provides a braking action that has controlled instantaneous results.

The use of this system may be practiced by a manufacturer involving the plastics stretch film on cores as illustrated in this invention, or by a user rewinding the film on a core of his choosing from a supply unit.

As can be readily understood from the foregoing description of the invention, the present structure and system can be configured or operated in different modes or ways to provide the ability to use plastics stretch film to package a unit or to secure a unit to a transporting means.

Accordingly, modifications and variations to which the invention is susceptible may be practiced without departing from the scope and intent of the appended claims.

What is claimed is:

1. An apparatus for manually applying plastics stretch films for packaging units consisting of:

a core for a roll of plastics stretch film, said core having extended ends; and a pair of flexible hand grips removably encircled about the ends of said core for control of the tension on said plastics stretch film while unrolling during manual application for packaging, said core having an outside diameter essentially the same as the inside diameter of said flexible hand grip so that inside surface of said flexible hand grip slidingly interfaces with the outside surface of said core.

2. The apparatus for manually applying plastics stretch films recited in claim 1, wherein said core is a hollow cylindrical single unit core.

3. The apparatus for manually applying plastics stretch films recited in claim 1, wherein said core is a rod-like single unit.

4. The apparatus for manually applying plastics stretch films recited in claim 2, wherein the length of said single unit core extends beyond each side of said roll of plastics stretch film for a distance slightly greater than the length of a said encircling flexible hand grip.

5. The apparatus for manually applying plastics stretch films recited in claim 2, wherein said pair of encircling flexible hand grips are each cylindrical and tube-like, having an outside and an inside surface, being open at each end, said inside surface thereof slidingly interfacing with the outside surface of said single unit core.

6. An apparatus for manually applying plastics stretch films for packaging units, comprising:

a core for a roll of plastics stretch film, said core consisting of the hollow cylindrical core of a roll of plastics stretch films, a pair of adapters for extending said core, one adapter for each side of said hollow cylindrical core, each said adapter consisting of a removable washer-like plug for insertion into each end of said hollow cylindrical core and a smaller diameter hollow cylindrical core removably affixed to the inside diameter of said washer-like plug; and a pair of flexible hand grips removably encircled about said smaller diameter hollow cylindrical core for control of the tension on said plastics stretch film while unrolling during manual application for packaging.

7. The apparatus for manually applying plastics stretch films recited in claim 6, wherein the length of said smaller diameter hollow cylindrical core extending beyond said washer-like plug is slightly greater than the length of a said flexible hand grip.

8. The apparatus for manually applying plastics stretch films recited in claim 6, wherein said pair of flexible hand grips are each cylindrical and tube-like, having an outside and an inside surface, being open at each end, said inside surface thereof slidingly interfacing with the outside surface of said smaller diameter hollow cylindrical core.

9. An apparatus for manually applying plastics stretch films for packaging units, comprising:

a core for a roll of plastics stretch film, said core consisting of a hollow cylindrical core of a roll of plastics stretch film, a pair of adapters for extending said core, with one adapter each side of said hollow cylindrical core, each said adapter consisting of a removal cylindrical plug for insertion into each end of said hollow cylindrical core, said cylindrical plug having a smaller diameter cylindrical extension centered thereon;

a pair of flexible hand grips removably encircled about said smaller diameter cylindrical extension for control of the tension on said plastics stretch film while unrolling during manual application for packaging, said smaller diameter cylindrical extension being of a length protruding beyond said cylindrical plug slightly greater than the length of said encircling hand grips.

10. The apparatus for manually applying plastics stretch films recited in claim 9, wherein said pair of flexible hand grips are each cylindrical and tube-like, having an outside and an inside surface, being open at each end, said inside surface thereof slidingly interfacing with the outside surface of said smaller diameter cylindrical extension centered on said cylindrical plug.

11. A method for manually applying plastics stretch film for packaging units consisting of winding a roll of said plastics stretch film on a core of extended length, encircling flexible hand grips about the ends of said core of extended length, and controlling the tension and speed of unrolling while applying said plastics stretch film to a unit being packaged by squeezing said flexible hand grips as a braking action.

* * * * *

UNITED STATES PATENT AND TRADEMARK OFFICE

CERTIFICATE OF CORRECTION

PATENT NO. : 4,179,081

DATED : DECEMBER 18, 1979

INVENTOR(S) : JOHN C. PARRY

It is certified that error appears in the above-identified patent and that said Letters Patent is hereby corrected as shown below:

Claim 9, line 8, change "removal" to --removable--.

Signed and Sealed this

Seventeenth Day of April, 1990

*Attest:*

HARRY F. MANBECK, JR.

*Attesting Officer*

*Commissioner of Patents and Trademarks*